US012279741B2

(12) United States Patent
Teo et al.

(10) Patent No.: US 12,279,741 B2
(45) Date of Patent: Apr. 22, 2025

(54) CLEANER HEAD FOR A VACUUM CLEANING APPLIANCE

(71) Applicant: Dyson Technology Limited, Wiltshire (GB)

(72) Inventors: Aaron Yii How Teo, Swindon (GB); Stefan Koch, Dorset (GB); Robert Michael Cox, Warwick (GB); Stuart Lloyd Genn, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 438 days.

(21) Appl. No.: 17/761,153

(22) PCT Filed: Sep. 23, 2020

(86) PCT No.: PCT/GB2020/052300
§ 371 (c)(1),
(2) Date: Mar. 16, 2022

(87) PCT Pub. No.: WO2021/064353
PCT Pub. Date: Apr. 8, 2021

(65) Prior Publication Data

US 2023/0346180 A1 Nov. 2, 2023

(30) Foreign Application Priority Data

Oct. 2, 2019 (GB) ..... 1914226

(51) Int. Cl.
*A47L 9/04* (2006.01)
*A46B 13/00* (2006.01)
(Continued)

(52) U.S. Cl.
CPC ..... *A47L 9/0488* (2013.01); *A46B 13/001* (2013.01); *A46B 13/02* (2013.01);
(Continued)

(58) Field of Classification Search
CPC ..... A47L 9/0477; A47L 9/009; A47L 9/0488; A47L 9/165; A47L 9/0494; A47L 11/4041; A47L 5/28; A47L 5/30; A47L 5/34
See application file for complete search history.

(56) References Cited

U.S. PATENT DOCUMENTS 4,325,156 A * 4/1982 Rosendall ..... A47L 11/4072 15/41.1
5,850,666 A 12/1998 Farone et al.
(Continued)

FOREIGN PATENT DOCUMENTS

CA 2658644 A1 9/2010
CN 101229030 A 7/2008
(Continued)

OTHER PUBLICATIONS

International Search Report and Written Opinion received for PCT Patent Application No. PCT/GB2020/052300, mailed on Dec. 9, 2020, 11 pages.
(Continued)

*Primary Examiner* — Robert F Neibaur
(74) *Attorney, Agent, or Firm* — Tucker Ellis LLP

(57) ABSTRACT

A cleaner head for a vacuum cleaning appliance includes a housing, a front agitator and a rear agitator. A suction chamber is located between the front agitator and the rear agitator. A baffle is located within the suction chamber between the agitators. During use of the cleaner head, debris becomes entrained within air drawn towards the suction chamber. Guide members mounted on the housing guide the entrained debris towards the suction chamber, whereas the baffle guides the air upwardly towards a central suction port of the suction chamber.

18 Claims, 15 Drawing Sheets

(51) Int. Cl.
*A46B 13/02* (2006.01)
*A47L 9/00* (2006.01)

(52) U.S. Cl.
CPC ..... *A47L 9/009* (2013.01); *A47L 9/0477* (2013.01); *A46B 2200/3033* (2013.01)

(56) References Cited

U.S. PATENT DOCUMENTS

| | | | |
|---|---|---|---|
| 7,150,068 | B1 | 12/2006 | Ragner |
| 8,910,340 | B2 | 12/2014 | Bradbury et al. |
| 9,901,231 | B2 * | 2/2018 | Tibberts ..... A47L 9/0653 |
| 2006/0242786 | A1 | 11/2006 | Moon et al. |
| 2011/0023263 | A1 | 2/2011 | Boyes |
| 2012/0144605 | A1 | 6/2012 | Dewings |
| 2013/0312216 | A1 | 11/2013 | Palmer et al. |
| 2014/0359967 | A1 | 12/2014 | Park et al. |
| 2015/0033498 | A1 | 2/2015 | McVey |
| 2016/0201278 | A1 | 7/2016 | Happonen et al. |
| 2017/0127896 | A1 | 5/2017 | Carter et al. |
| 2018/0289226 | A1 | 10/2018 | De Wit |
| 2019/0150686 | A1 | 5/2019 | Horne et al. |
| 2021/0164180 | A1 | 6/2021 | Happonen et al. |
| 2022/0400915 | A1 | 12/2022 | Teo et al. |

FOREIGN PATENT DOCUMENTS

| | | | |
|---|---|---|---|
| CN | 101524259 | A | 9/2009 |
| CN | 101983028 | A | 3/2011 |
| CN | 103120570 | A | 5/2013 |
| CN | 104337463 | A | 2/2015 |
| CN | 204363905 | U | 6/2015 |
| CN | 105307550 | A | 2/2016 |
| CN | 105780698 | A | 7/2016 |
| CN | 105916424 | A | 8/2016 |
| CN | 106963290 | A | 7/2017 |
| CN | 108471917 | A | 8/2018 |
| CN | 108903798 | A | 11/2018 |
| CN | 109195495 | A | 1/2019 |
| CN | 208926210 | U | 6/2019 |
| CN | 209421834 | U | 9/2019 |
| DE | 102014116589 | A1 | 5/2016 |
| DE | 102017208960 | A1 | 11/2018 |
| FR | 2724613 | A1 | 3/1996 |
| GB | 2476810 | A | 7/2011 |
| GB | 2520549 | A | 5/2015 |
| GB | 2558598 | A | 7/2018 |
| JP | 50-029465 | U | 4/1975 |
| JP | 52-087059 | U | 6/1977 |
| JP | 05-044039 | U | 6/1993 |
| JP | 06-066547 | U | 9/1994 |
| JP | 09-010143 | A | 1/1997 |
| JP | 09-047396 | A | 2/1997 |
| JP | 11-192192 | A | 7/1999 |
| JP | 11-244204 | A | 9/1999 |
| JP | 2002-177170 | A | 6/2002 |
| JP | 2017-159177 | A | 9/2017 |
| JP | 2018-110855 | A | 7/2018 |
| KR | 1998-0023602 | U | 7/1998 |
| KR | 10-2008-0105600 | A | 12/2008 |
| KR | 10-2015-0038597 | A | 4/2015 |
| KR | 10-2019-0100361 | A | 8/2019 |
| WO | 2007/065034 | A1 | 6/2007 |
| WO | 2008/098855 | A1 | 8/2008 |
| WO | 2013/005522 | A1 | 1/2013 |
| WO | 2015/075481 | A1 | 5/2015 |
| WO | 2017/106900 | A1 | 6/2017 |
| WO | 2020/213075 | A1 | 10/2020 |

OTHER PUBLICATIONS

International Search Report and Written Opinion received for PCT Patent Application No. PCT/GB2020/052342, mailed on Dec. 9, 2020, 11 pages.
International Search Report and Written Opinion received for PCT Patent Application No. PCT/GB2020/052433, mailed on Jan. 14, 2021, 13 pages.
Search Report received for Great Britain Patent Application No. 1914226.4, mailed on Mar. 5, 2020, 1 page.
Search Report received for Great Britain Patent Application No. 1914228.0, mailed on Mar. 5, 2020, 1 page.
Office Action received for Japanese Patent Application No. 2021-522962, mailed on May 10, 2022, 8 pages (4 pages of English Translation and 4 pages of Original Document).
Office Action received for Chinese Patent Application No. 202080066463.1, mailed on Nov. 2, 2022, 15 pages (9 pages of English Translation and 6 pages of Original Document).
Office Action received for Chinese Patent Application No. 202080069697.1, mailed on Nov. 30, 2022, 23 pages (13 pages of English Translation and 10 pages of Original Document).
Office Action received for Chinese Patent Application No. 202080069706.7, mailed on Jan. 3, 2023, 20 pages (11 pages of English Translation and 9 pages of Original Document).
Office Action received for Chinese Patent Application No. 202080066463.1, mailed on Jul. 5, 2023, 19 pages (11 pages of English Translation and 8 pages of Original Document).
Office Action received for Japanese Patent Application No. 2022-520609, mailed on Jun. 13, 2023, 7 pages (4 pages of English Translation and 3 pages of Original Document).

* cited by examiner (a)

(b)

CLEANER HEAD FOR A VACUUM CLEANING APPLIANCE

CROSS-REFERENCE TO PRIOR APPLICATION

This application is a § 371 National Stage Application of PCT International Application No. PCT/GB2020/052300 filed Sep. 23, 2020, which claims the priority of United Kingdom Application No. 1914226.4, filed Oct. 2, 2019, each of which are herein incorporated by reference in their entirety.

FIELD OF THE INVENTION

The present invention relates to a cleaner head for a vacuum cleaning appliance.

BACKGROUND OF THE INVENTION

A vacuum cleaner typically comprises a main body containing dirt and dust separating apparatus, a cleaner head connected to the main body and having a suction inlet, and a motor-driven fan unit for drawing dirt-bearing air through the suction inlet and the cleaner head, and into the main body. The suction inlet is directed downwardly to face the floor surface to be cleaned. The dirt-bearing air is conveyed to the separating apparatus so that dirt and dust can be separated from the air before the air is expelled to the atmosphere. The separating apparatus can include one or more of a filter, a filter bag and a cyclonic arrangement.

A driven agitator, usually in the form of a brush bar, may be rotatably mounted within a suction chamber of the cleaner head. The brush bar typically comprises an elongate cylindrical core bearing bristles which extend radially outward from the core. The suction inlet may be in the form of an aperture, usually an elongate, rectangular aperture, defined by a sole plate located on the base of the cleaner head. The brush bar may be mounted within the suction chamber so that the bristles protrude by a small extent through the suction inlet.

The brush bar is activated mainly when the vacuum cleaner is used to clean carpeted surfaces. Rotation of the brush bar may be driven by an electric motor powered by a power supply derived from the main body of the vacuum cleaner, or by a turbine driven by an air flow passing through or into the cleaner head. The brush bar may be driven by the motor via a drive belt, or may be driven directly by the motor, so as to rotate within the suction chamber. Rotation of the brush bar causes the bristles to sweep along the surface of the carpet, agitating both the fibres of the carpet and any dust or other detritus located on the surface of the carpet and/or between fibres of the carpet, and resulting in a significant amount of energy being imparted to the dust. With the brush bar rotating in such a direction that the bristles move from the front edge of the suction inlet towards the rear edge, the rotating bristles sweep dust rearwardly through the suction inlet and into the suction chamber. The suction of air causes air to flow underneath the sole plate and around the brush bar to help lift the dirt and dust from the surface of the carpet and then carry it from the suction inlet through the cleaner head towards the separating apparatus.

It is known to provide a cleaner head which includes a pair of contra-rotating brush bars. For example, WO 2018/127680 describes a cleaner head which includes a front brush bar located at a front of the cleaner head, and a rear brush bar located at the rear of the cleaner head. The brush bars rotate in opposite angular directions so that the bristles of the front brush bar are swept rearwardly over the floor surface, and the bristles of the rear brush bar are swept forwardly over the floor surface. A suction chamber is located between the brush bars, and a suction port is located centrally at the top of the suction chamber.

In use, as such a cleaner head is moved forwards over a floor surface large debris, such as rice or Cheerios® which have become entrained within the air drawn towards the cleaner head, is unable to pass beneath the brush bar, due to its contact with the floor surface, and so enters the suction chamber from around the ends of the front brush bar. From there, the large debris passes along suction chamber, from both ends of the front agitator, towards the suction port. As the movement of the cleaner head is reversed, such debris enters the suction chamber from around the ends of the rear agitator, and passes along the suction chamber, from both ends of the rear agitator, towards the suction port.

SUMMARY OF THE INVENTION

In a first aspect, the present invention provides a cleaner head for a vacuum cleaning appliance, the cleaner head comprising:

- a housing;
- a front agitator supported for rotation relative to the housing in a first rotational direction;
- a rear agitator supported for rotation relative to the housing in a second rotational direction opposite to the first rotational direction;
- a suction chamber located between the front agitator and the rear agitator; and
- a baffle located within the suction chamber;
- wherein the suction chamber comprising a suction port located above the baffle, during use the baffle guiding air towards the suction port.

Each agitator preferably comprises a brush bar which rotates about the longitudinal axis thereof. The front agitator rotates in the first rotational direction so as to sweep dirt and debris rearwardly towards the suction chamber, and the rear agitator rotates in the second rotational direction so as to sweep dirt and debris forwardly towards the suction chamber. The agitators preferably rotate at the same angular speed so that the traction generated by the agitators is equal and opposite. The agitators are preferably cylindrical in shape. The agitators are preferably arranged so that their longitudinal axes are parallel, and are preferably horizontal when the cleaner head is positioned on a floor surface. The housing preferably defines a front opening which exposes the first agitator at the front of the cleaner head, and a rear opening which exposes the second agitator at the rear of the cleaner head.

In use, air enters the suction chamber through at least one suction inlet, and exits the suction chamber through a suction port. The suction chamber preferably comprises a central suction port, that is, a port which is located both midway between the front agitator and the rear agitator, and midway between the side edges of the suction chamber. As mentioned above, the cleaner head comprises a baffle located within the suction chamber, and thus between the agitators. The baffle is preferably located beneath the suction port, preferably so that the baffle is located vertically beneath the suction port during use of the cleaner head.

The baffle is preferably disposed on, more preferably integral with, a baffle plate which extends across the suction chamber, preferably lengthways across the suction chamber (the length direction extending parallel to the longitudinal axes of the agitators). The baffle plate is preferably located at the bottom of the suction chamber, preferably so that a lower surface of the baffle plate is substantially-coplanar with the lowermost portions of the agitators. The baffle plate is preferably spaced from each of the agitators. The baffle plate thus preferably at least partially defines a front suction inlet, located between the front agitator and the baffle plate, and a rear suction inlet, located between the rear agitator and the baffle plate. The front and the rear suction inlets are downwardly-facing, co-planar, and preferably have the same shape and the same size.

The baffle plate is preferably detachably connected to the cleaner head. The baffle plate is preferably connected directly to the housing of the cleaner head, preferably by a user accessible snap-fit connection or catch mechanism to facilitate manufacture and quick maintenance for any blockages that occur in the suction port.

The baffle plate has a front edge located adjacent to the front agitator, and a rear edge located adjacent to the rear agitator. As the cleaner head is moved forwards over a floor surface, large debris, which has become entrained within the air drawn towards the front of the cleaner head, is guided along the front edge of the baffle plate towards the suction port. As the cleaner head is moved backwards over a floor surface, large debris, which has become entrained within the air drawn towards the cleaner head, is guided along the rear edge of the baffle plate towards the suction port. This promotes the movement of the entrained debris directly towards the suction port, and thus improves the performance of the cleaner head. The front edge and the rear edge of the baffle plate preferably taper inwardly towards the suction port, so that the width of the baffle plate (as measured perpendicular to its length) at its centre is smaller than the width of the baffle plate at its two ends.

As mentioned above, the baffle plate comprises a baffle which, during use, guides air towards the suction port. The baffle is preferably located vertically beneath the suction port during use of the cleaner head. The baffle preferably extends towards the suction port, and preferably tapers towards the suction port, so as to guide the airflow to turn through 90° towards the suction port. The baffle may be curved, or may be conical in shape. In a preferred embodiment, the baffle is substantially pyramidal in shape, with each face of the baffle arranged to guide a respective airflow towards the suction port. During use, air tends to enter the cleaner head from the ends of the agitators and move, in opposing directions, towards the suction port. In the absence of a baffle, there is a risk that the opposing airflows can collide within the suction chamber and generate a "dead zone" of low airflow velocity and high turbulence directly below the suction chamber. Within such a deadzone, there may be insufficient airflow velocity to evacuate any debris that gets trapped within the dead zone, with the result that the debris will lie stagnant on the floor surface, leaving an accumulation of debris on the floor surface. The presence of the baffle inhibits the formation of such a dead zone by guiding the air within the suction chamber to turn upwardly towards the suction port, promoting smooth coalescence of the opposing airflows within the suction chamber and movement of the entrained debris towards the suction port.

The cleaner head preferably comprises front guide members attached to the housing for, during use, guiding the debris from the ends of the front agitator towards the suction chamber, and rear guide members attached to the housing for, during use, guiding debris from the ends of the rear agitator towards the suction chamber.

We have found that the use of guide members to guide debris, particularly, but not exclusively, large debris such as rice and Cheerios®, towards the suction chamber can reduce the risk of blockage of the pathways extending inwardly from the ends of the agitators towards the suction chamber. Any blocking of those pathways can inhibit the passage of larger debris into the suction chamber, with the result that the debris remains on the floor surface when the appliance is switched off.

The front and rear guide members are preferably located between the agitators. Each of the front guide members is preferably located adjacent a respective end of the front agitator. Each of the front guide members is preferably located immediately behind the front agitator. As the cleaner head is moved in a forward direction over a floor surface, each of the front guide members preferably defines, at least partially with the front agitator, a respective front channel along which entrained debris is guided towards the front suction inlet (and thus towards the suction chamber).

Similarly, each of the rear guide members is preferably located adjacent a respective end of the rear agitator. Each of the rear guide members is preferably located immediately in front of the rear agitator. As the cleaner head moved in a backward direction over the floor surface, each of the rear guide members preferably defines, at least partially with the rear agitator, a respective rear channel along which entrained debris is guided towards the rear suction inlet (and thus towards the suction chamber).

The front and rear guide members are preferably arranged to rotate relative to the housing in response to a change in the direction of movement of the cleaner head over a surface, such as a hard floor surface or a carpeted surface. The cleaner head preferably comprises a plurality of wheels for engaging the surface over which the cleaner head is being maneuvered by the user. The cleaner head preferably comprises a pair of front wheels, and a pair of rear wheels. The wheels are preferably located between the agitators. Each wheel is preferably in the form of a caster, but the wheel may be in the form of a ball or other rolling member. Each wheel is preferably arranged to rotate relative to the housing about a first axis which is perpendicular to the suction inlet, so as to allow a change in the direction in which the cleaner head is moved over a surface. Each of the wheels is preferably arranged to rotate freely about the first axis, and so about an angle of 360°. This allows the cleaner head to be maneuvered over a floor surface, for example, in any chosen direction by the user. For example, the user may move the cleaner head back and forth, from side to side, and/or in a curved direction. Each wheel is also preferably arranged to rotate relative to the guide member about a second axis which is perpendicular to the first axis.

Each of the front guide members and the rear guide members is preferably arranged to rotate with a respective wheel, most preferably about the first axis. This can allow the guide member to optimally guide the entrained debris towards the suction chamber. As the cleaner head is moved forwards, the front guide members rotate with the front wheels to define the front channels for guiding debris towards the suction chamber, and as the cleaner head is moved backwards the rear guide members rotate with the rear wheels to define the rear channels for guiding debris towards the suction chamber.

Each of the front and rear guide members preferably comprises a guide surface for guiding the entrained debris towards the suction chamber. The guide surface is preferably arranged orthogonal to the suction inlet, and thus orthogonal to the second axis about which the wheel rotates relative to the guide member.

As mentioned above, the wheel is preferably in the form of a caster, which is preferably mounted on a support which is rotatable relative to the housing about the first axis. The caster wheel is mounted on axle which is snap-fitted into the support to allow the wheel to rotate relative to the support about the second axis. The support for the caster wheel may conveniently define the guide member for guiding debris towards the suction chamber, whilst the external surface of the support may define the guide surface for guiding debris towards the suction chamber (through impact between the debris and the guide surface). The guide surface is preferably shaped so that the angle of incidence of the debris on the guide surface is such that the debris moves towards the suction chamber as it rebounds from the guide surface. The guide surface preferably has a convex shape. For example, the guide surface may have one of a curved and a polygonal shape. The curved shape may be symmetrical or asymmetrical. The polygonal shape may be regular or irregular.

As an alternative to using a support for the caster wheel to provide the guide member for guiding the debris towards the suction chamber, the guide member may extend at least partially about the support. The guide member may be mounted on the support. Alternatively, the guide member and the support may be mounted on a common base or other cleaner head component which is rotatable relative to the housing. This can enable the guide member to be formed from a different material to the support for the caster wheel. For example, whilst the support may be formed from a relatively rigid material, for example a plastics material such as a polycarbonate, the guide member may be formed from a relatively flexible material, for example a polyurethane such as TPU. Providing the guide member as a separate component to the support for the wheel can enable a greater degree of control of the direction and/or speed at which the impacting debris moves away from the guide member, through selection of the shape and/or material from which the guide member is formed.

The front and/or rear guide members may be used in other types of cleaner head to guide debris towards the suction chamber. For example, a passive cleaner head, that is, a cleaner head which does not include any moving agitators for agitating debris from a floor surface, may include an arrangement of wheels and guide members for guiding debris towards the suction chamber. The wheels may be mounted on a sole plate which defines a suction inlet of the cleaner head. For example, a pair of front wheels may be located adjacent a front edge of the cleaner head, and a pair of rear wheels may be located adjacent a rear edge of the cleaner head. Each wheel may be located adjacent a front corner of the cleaner head, with each wheel being associated with a guide member which rotates with the wheel relative to the housing to guide debris towards the suction inlet. As another example, a cleaner head may comprise a single agitator or brush bar, which may be located towards the front of the cleaner head, with front and rear wheels, and so front and rear guide members, located rearwardly of the agitator.

In a second aspect, the present invention provides a cleaner head for a vacuum cleaning appliance, the cleaner head comprising:

- a housing defining a suction chamber, the suction chamber having a downwardly-facing suction inlet and a suction port; and
- a plurality of wheels for supporting the cleaner head, each wheel being rotatable relative to the housing about a first axis which is perpendicular to the suction inlet; and
- a plurality of guide members for guiding into the suction chamber debris entrained within air drawn towards the suction inlet, each guide member being arranged to rotate with a respective wheel about the first axis.

The wheels may be mounted directly on the housing of the cleaner head for rotation relative thereto. Alternatively, the wheels may be rotatably mounted on one or more cartridges which are connected to the housing. For example, the cleaner head may comprises a first cartridge located on one side of the suction inlet, and a second cartridge located on the other side of the suction inlet. Each cartridge may comprise a respective one of the front wheels and a respective one of the rear wheels.

In an embodiment where the cleaner head comprises both a front agitator and a rear agitator, each cartridge preferably comprises a respective one of each of the front guide members and the rear guide members. Each cartridge is preferably located between the front agitator and the rear agitator, and is preferably located on a respective side of the suction chamber. Each cartridge preferably comprises a plurality of apertures, each being located adjacent a respective one of the agitators, and through which entrained debris enters a respective one of the channels along which debris is guided towards the suction chamber.

Where the cleaner comprises a single agitator, each cartridge also preferably comprises a pair of wheels and a pair of guide members which are each rotatable relative to the cartridge with a respective one of the wheels. Each cartridge is preferably located rearwardly of the agitator, and is preferably disposed on a respective side of the suction chamber.

Each cartridge is preferably arranged such that the first axes of the wheels of that cartridge are located in a plane which is orthogonal to the suction inlet. Where the cleaner head comprises an agitator which rotates about an axis which extends in a direction which is parallel to the suction inlet, this plane is preferably orthogonal to the rotational axis of the agitator.

Features described above in connection with the first aspect of the invention are equally applicable to the second aspect of the invention, and vice versa. The terms "horizontal", "vertical", "front", and "rear" are used in the context of the present application to refer to relative orientations or positions of components of the cleaner head when in normal use.

BRIEF DESCRIPTION OF THE DRAWINGS

Preferred features of the present invention will now be described by way of example only with reference to the accompanying drawings, in which.

DETAILED DESCRIPTION OF THE INVENTION

Figure 1:
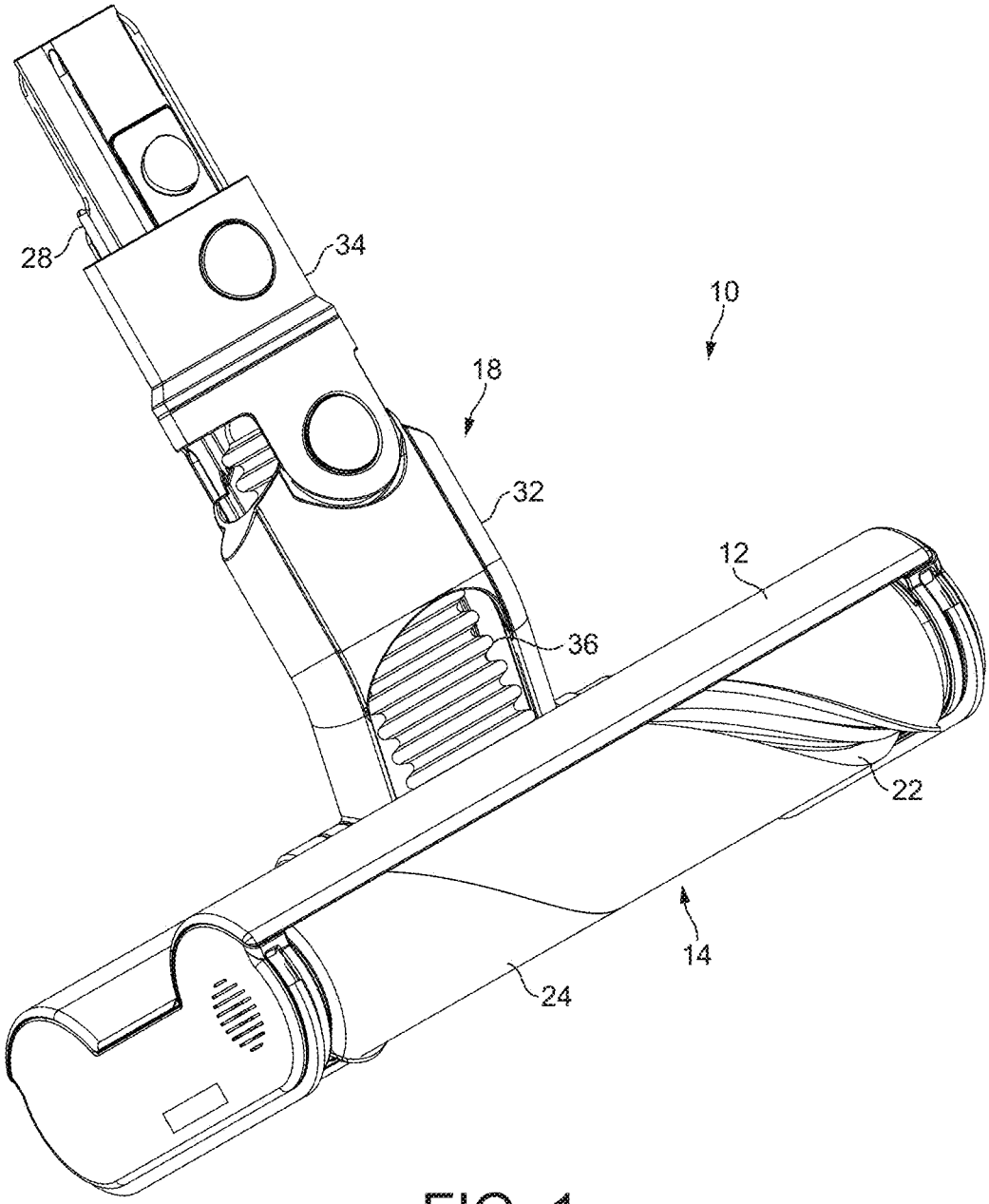
FIG. 1 is an angled view of a cleaner head.
Figure 2:
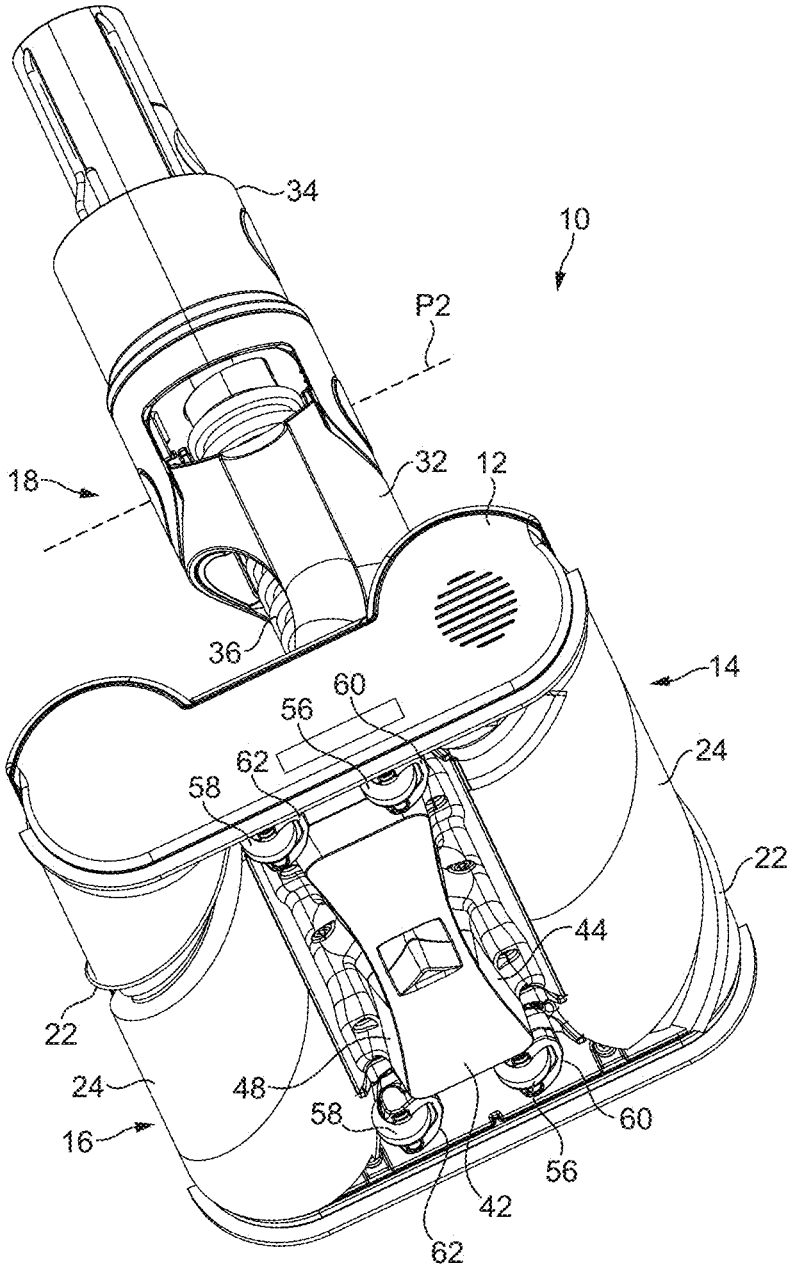
FIG. 2 is a perspective view, from below, of the cleaner head.

FIGS. 1 to 15 illustrate an example of a cleaner head 10 for a vacuum cleaning appliance. The cleaner head 10 comprises a housing 12, a front agitator 14 and a rear agitator 16 each mounted to the housing 12 for rotation relative thereto, and a neck 18 connected to the housing 12.

Each agitator 14, 16 is in the form of a brush bar comprising an elongate body 20 to which bristles, flicker strips or other means 22 for agitating a surface are attached. In the present embodiment, the elongate body 20 is covered with a plush of synthetic fibres 24. The housing 12 is shaped to expose the front surface of the front agitator 14, and to expose the rear surface of the rear agitator 16 so that the agitators 14, 16 can provide relatively soft front and rear bumpers of the cleaner head 10.

The agitators 14, 16 are driven to rotate in opposite directions about axes of rotation X1, X2 which are parallel to one another, and which are each collinear with the longitudinal axis of its respective agitator 14, 16. When the cleaner head is located on a floor surface or other surface to be cleaned, the rotational axes are horizontal. The angular directions of rotation of the agitators 14, 16 are selected so that dirt and debris is swept from a floor surface into a suction chamber 26 located between the agitators 14, 16. Consequently in FIG. 7 the front agitator 14 rotates relative to the housing 12 in a clockwise direction about axis X1, and the rear agitator 16 rotates relative to the housing 12 in an anticlockwise direction about axis X2.

Figure 3:
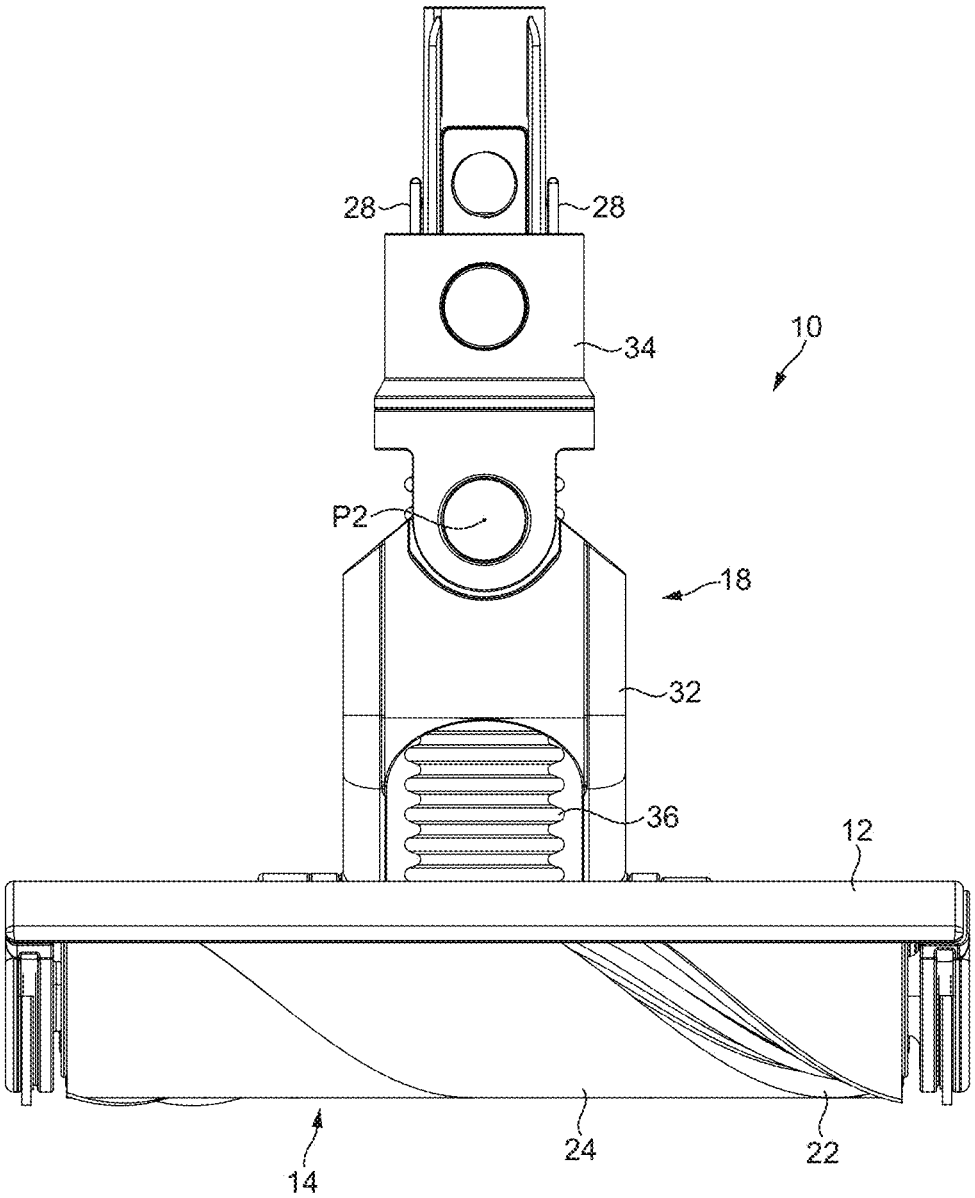
FIG. 3 is a front view of the cleaner head.
Figure 4:
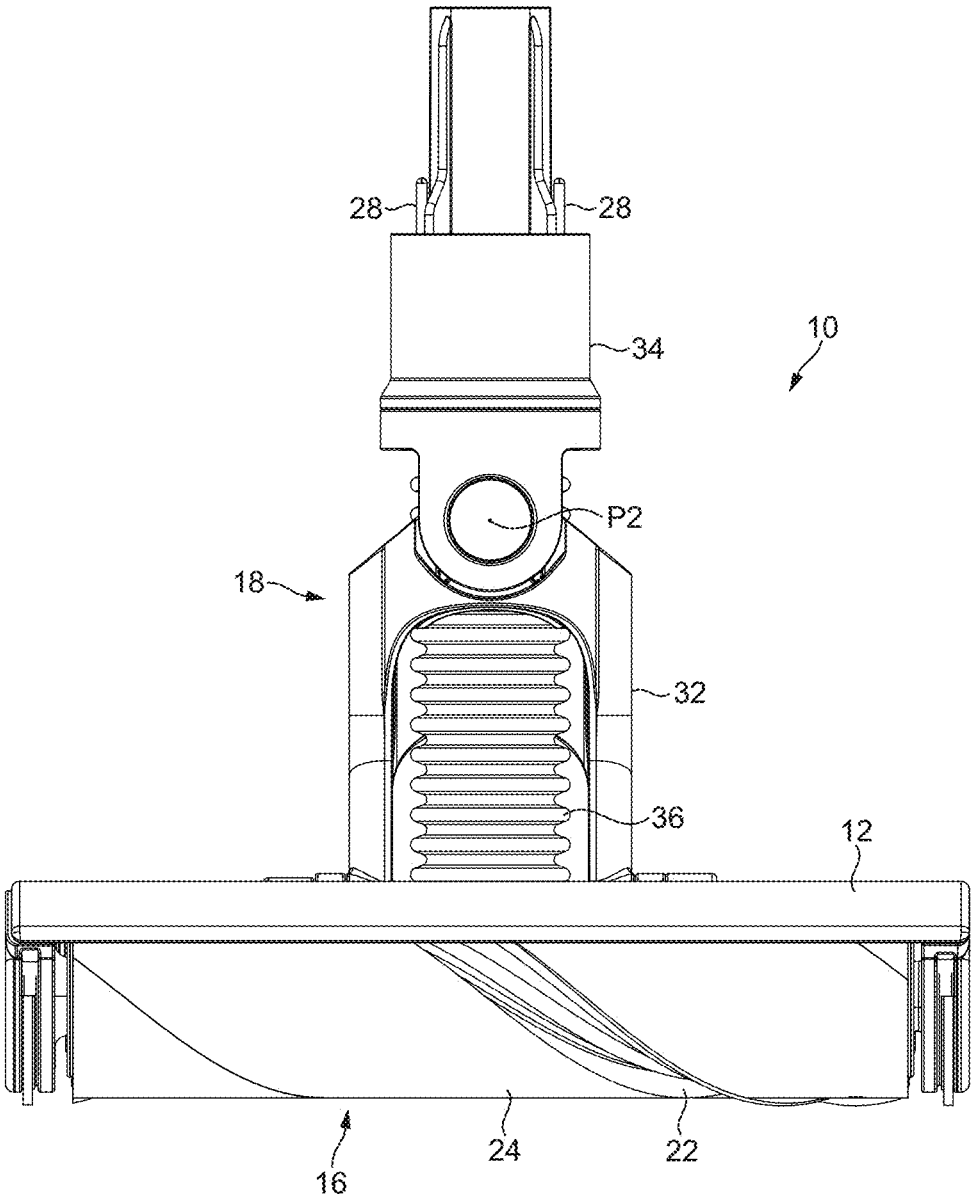
FIG. 4 is a rear view of the cleaner head.
Figure 5:
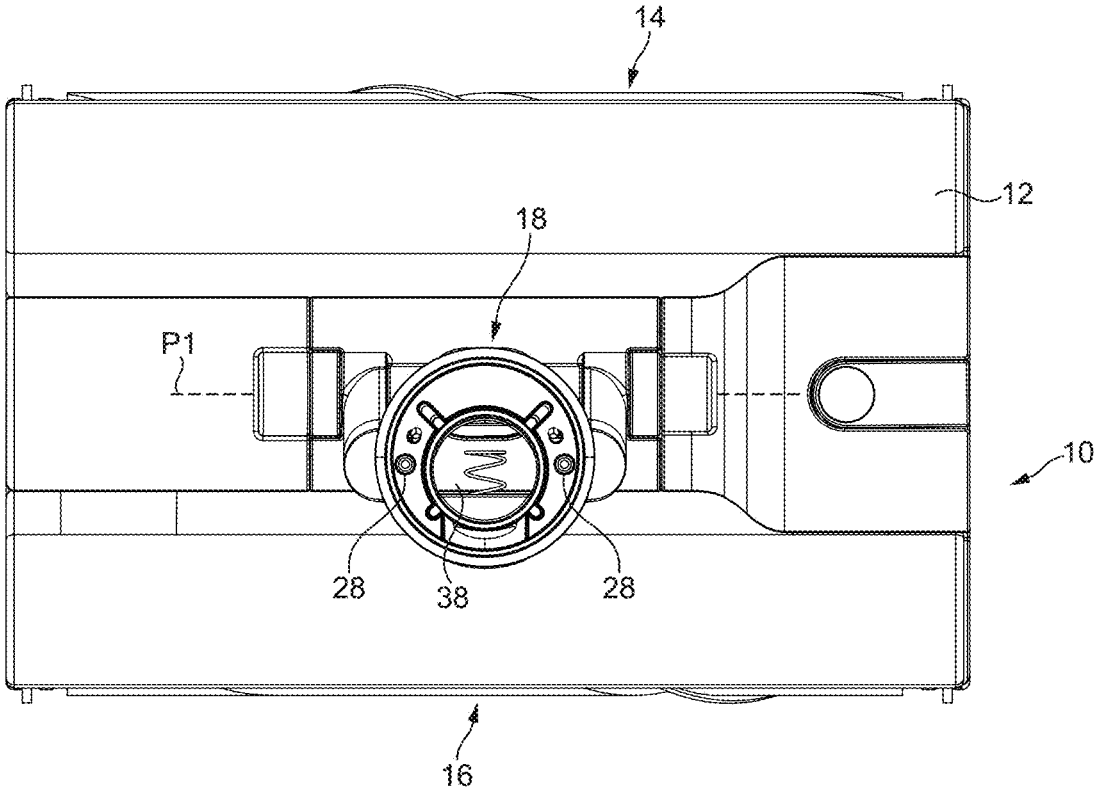
FIG. 5 is a top view of the cleaner head.

The cleaner head 10 comprises a drive assembly for driving the rotation of the agitators 14, 16 relative to the housing 12. The drive assembly is arranged to drive the agitators to rotate relative to the housing 12 at the same angular velocity. The particular details of the drive assembly are not pertinent to the present invention, but in overview the drive assembly comprises an electric motor and a transmission for transmitting torque generated by the motor to each of the agitators 14, 16. The motor may be mounted in the housing 12. Alternatively, the motor may be mounted in one of the agitators 14, 16. Power is supplied to the motor from the vacuum cleaning appliance. As illustrated in FIGS. 3 to 5, the neck 18 comprises a pair of electrical terminals 28 for engaging electrical contacts located on the appliance to supply power from the appliance to the motor. Electrical cables 30 (visible in FIG. 9) extend between the terminals 28 and the motor. The transmission may comprise a gear train for transferring torque from the motor to a driven one of the agitators 14, 16, and a belt and pulley system for transferring torque from the driven agitator to the other agitator.

Rather than using a single motor to drive both agitators 14, 16 the drive assembly may comprise two electric motors, each driving a respective agitator 14, 16. Alternatively, rather than using one or more electric motors, the drive assembly may comprise an air turbine to generate the torque necessary to drive the agitators 14, 16.

The neck 18 is pivotally connected to the top of the housing 12. The neck 18 pivots relative to the housing 2 about a pivot axis P1 that is parallel to the rotational axes X1, X2, of the agitators 14, 16. The neck 18 is pivotally attached to the housing 12 at positions midway between the agitators 14, 16. As a result, the pivot axis P1 of the neck 18 is equidistant from the rotational axes X1, X2 of the agitators 14, 16. The neck 18 comprises a lower neck section 32 which is pivotally connected to the housing 12, and an upper neck section 34 which is pivotally connected to the lower neck section 32 for pivoting movement about pivot axis P2 which is orthogonal to pivot axis P1. The neck 18 comprises a conduit 36 that extends from an outlet 38 located at a free end of the neck 18 to a suction port 40 formed in the top of the housing 12, and through which air enters the conduit 36 from the suction chamber 26. The suction port 40 is centrally located, that is, it is located midway between the agitators 14, 16, and midway between the sides of the suction chamber 26. The free end of the neck 18 is attachable to a wand of a vacuum cleaning appliance (not shown). The wand is then used to manoeuvre the cleaner head 10 over the floor surface, as well as deliver electrical power to the motor via the electrical terminals 28.

The cleaner head 10 comprises a baffle plate 42 located within the suction chamber 26. The baffle plate 42 is located at the bottom of the suction chamber 26, preferably so that a bottom surface of the baffle plate 42 is substantially co-planar with the lowermost extremities of the agitators 14, 16. The baffle plate 42 is connected to the housing 12, preferably by means of a snap-fit connection which allows the baffle plate 42 to be replaceably detached from the housing 12 for maintenance of the cleaner head 10. The baffle plate 42 preferably extends lengthways across the suction chamber 26, from one side of the suction chamber 26 to the other. The baffle plate 42 has a front edge 44 which defines with the front agitator 14 a front suction inlet 46 of the suction chamber 26, and a rear edge 48 which defines with the rear agitator 16 a rear suction inlet 50 of the suction chamber 26. As described in more detail below, the baffle plate 42 comprises a baffle 52 for guiding air towards the suction port 40 of the suction chamber 26. The baffle 52 is located centrally on the baffle plate 42 so that it is positioned vertically beneath the suction port 40, and is preferably integral with the baffle plate 42.

The baffle 52 extends upwardly towards, and preferably tapers towards, the suction port 40. In this embodiment, the baffle 52 is generally pyramidal in shape, and comprises a plurality of equally sized faces 54 which each guide a respective portion of the air passing through the suction chamber 26 towards the suction port 40.

The cleaner head 10 further comprises a plurality of wheels for supporting the cleaner head 10 on a floor surface. The wheels are located between the front agitator 14 and the rear agitator 16. In this embodiment, the cleaner head 10 comprises a pair of front wheels 56 and a pair of rear wheels 58. The front wheels 56 are located on opposite sides of the front suction opening 46, and are each located adjacent a respective end of the front agitator 14. The rear wheels 58 are located immediately behind the front wheels 56, and on opposite sides of the rear suction opening 50. Each of the rear wheels 58 is located adjacent a respective end of the rear agitator 16.

Figure 13:
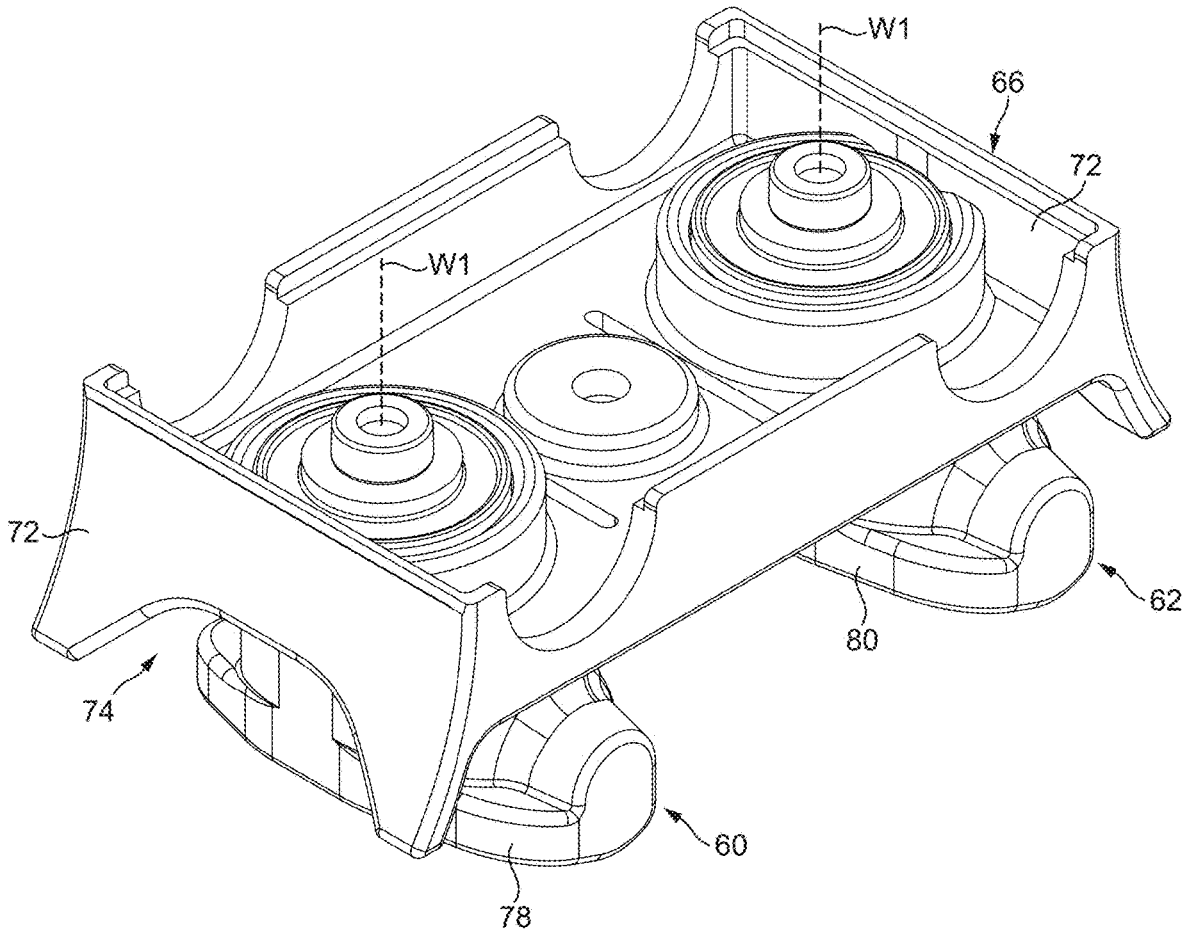
FIG. 13 is a perspective view, from above, of a caster cartridge of the cleaner head.
Figure 14:
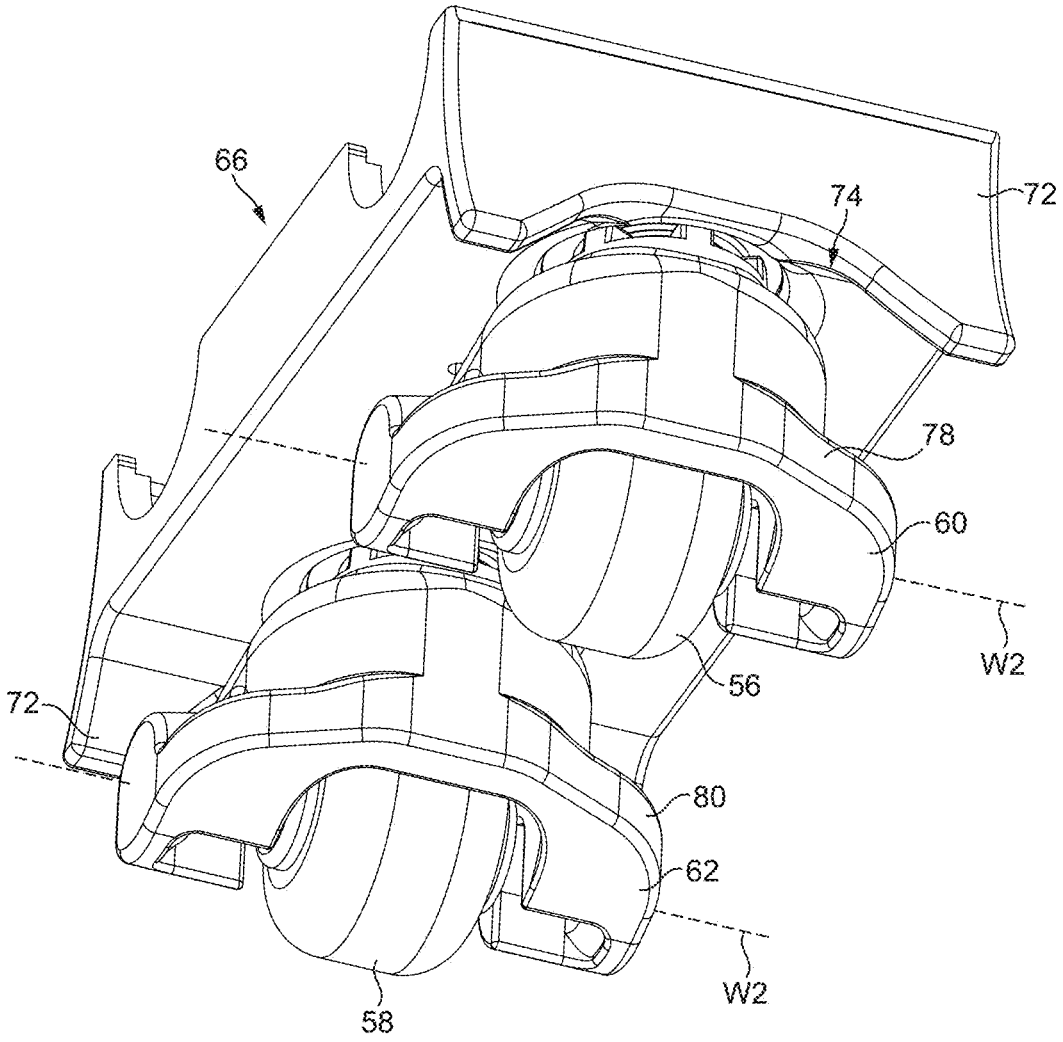
FIG. 14 is a perspective view, from below, of the caster cartridge.
Figure 15:
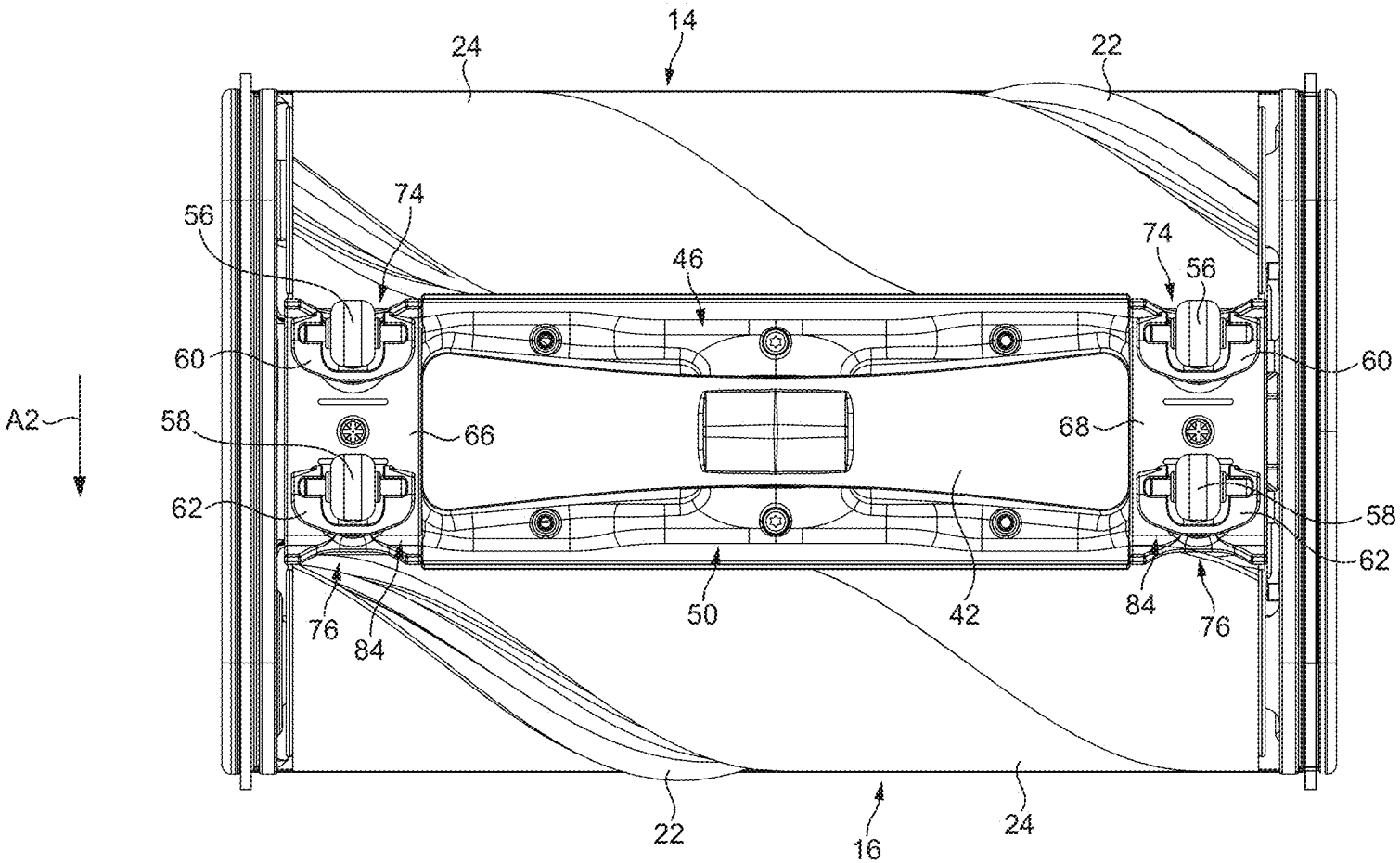
FIG. 15 is another bottom view of the cleaner head, with casters of the cleaner head in a second orientation relative to the housing.

With particular reference to FIGS. 13 and 14, in this embodiment the wheels 56, 58 are in the form of casters.

Each front wheel 56 is mounted on a front support 60, and each rear wheel 58 is mounted on a rear support 62. Each support 60, 62 is connected to the housing 12 so that the support, and thus each wheel 56, 58, is rotatable relative to the housing 12 about a first rotational axis W1 which is orthogonal to the rotational axes X1, X2 of the agitators 14, 16, and so orthogonal to the front and rear suction inlets 46, 50. Each wheel 56, 58 is connected to its respective support 60, 62 by an axle 64 which is snap-fitted to the support 60, 62. This allows each wheel 56, 58 to rotate relative to its support 60, 62 about a second rotational axis W2 which is orthogonal to the first rotational axis W1. The freedom of movement of the wheels 56, 58 about the first and second rotational axes W1, W2 allows the cleaner head 10 to be maneuvered over a floor surface in any chosen direction, for example, back and forth, from side to side, or along a curved path.

Figure 6:
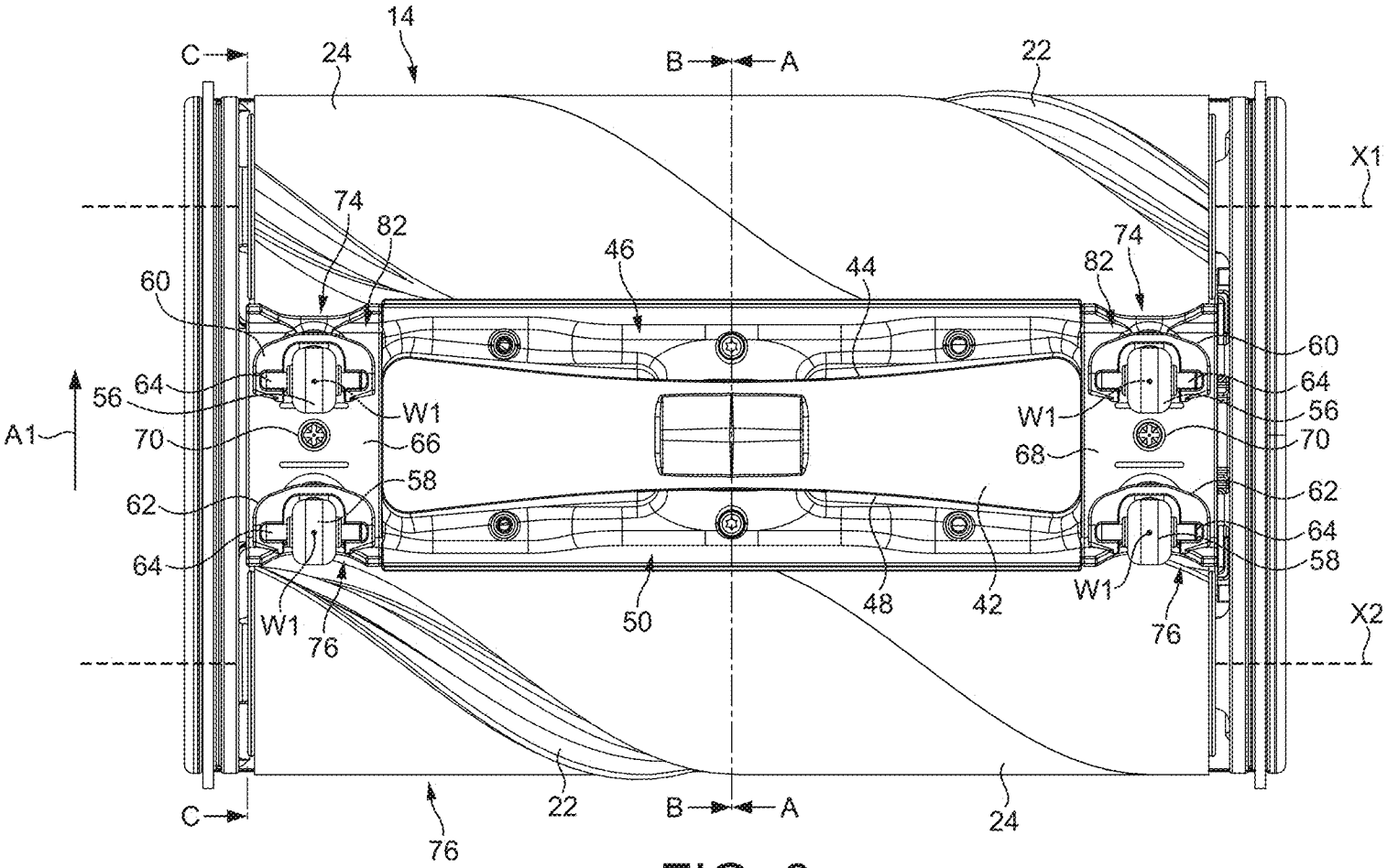
FIG. 6 is a bottom view of the cleaner head, with casters of the cleaner head in a first orientation relative to a housing of the cleaner head.
Figure 7:
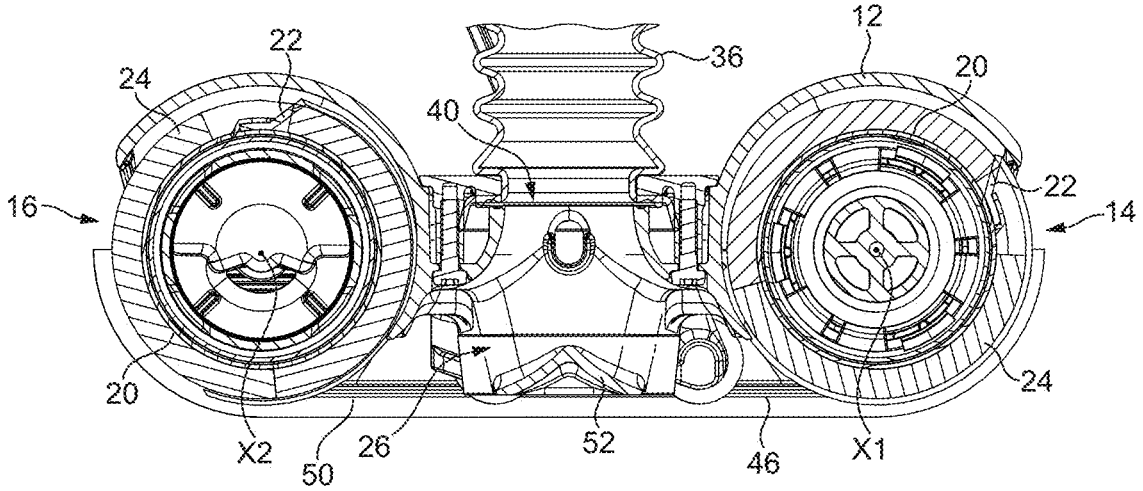
FIG. 7 is a section view of the part of the cleaner head, taken along line A-A in FIG. 6.
Figure 8:
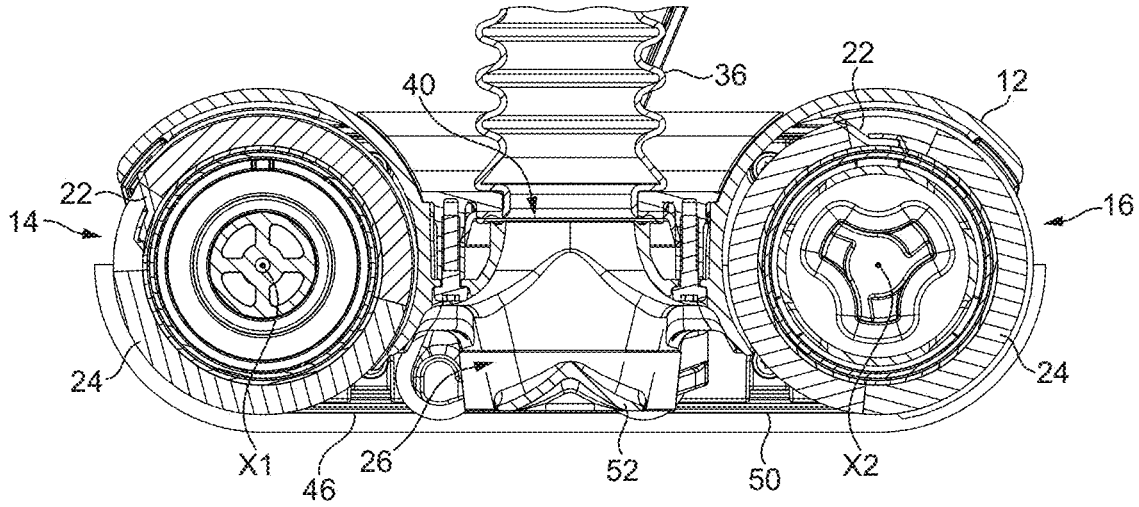
FIG. 8 is a section view of the part of the cleaner head, taken along line B-B in FIG. 6.
Figure 9:
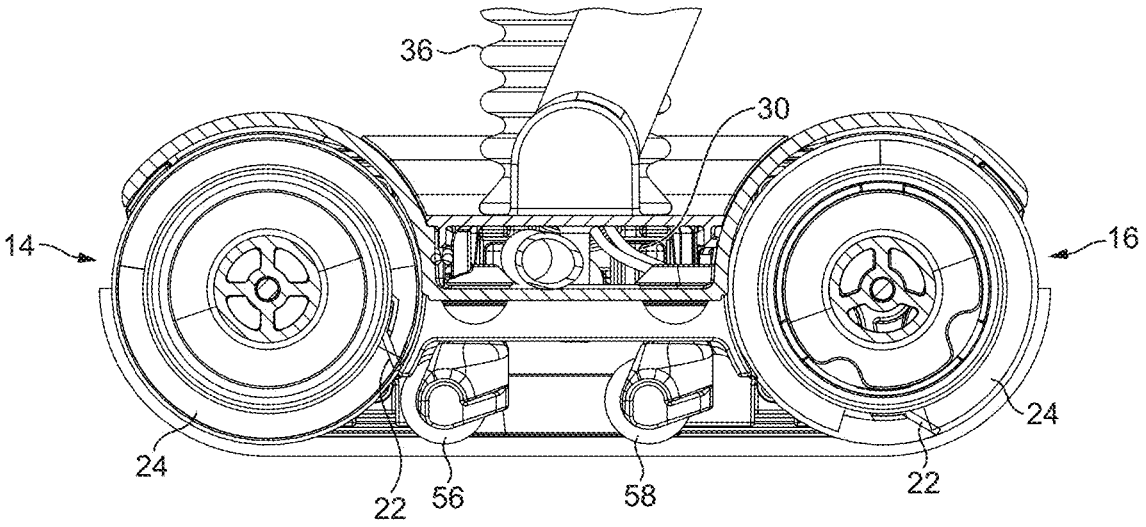
FIG. 9 is a section view of the part of the cleaner head, taken along line C-C in FIG. 6.
Figure 10:
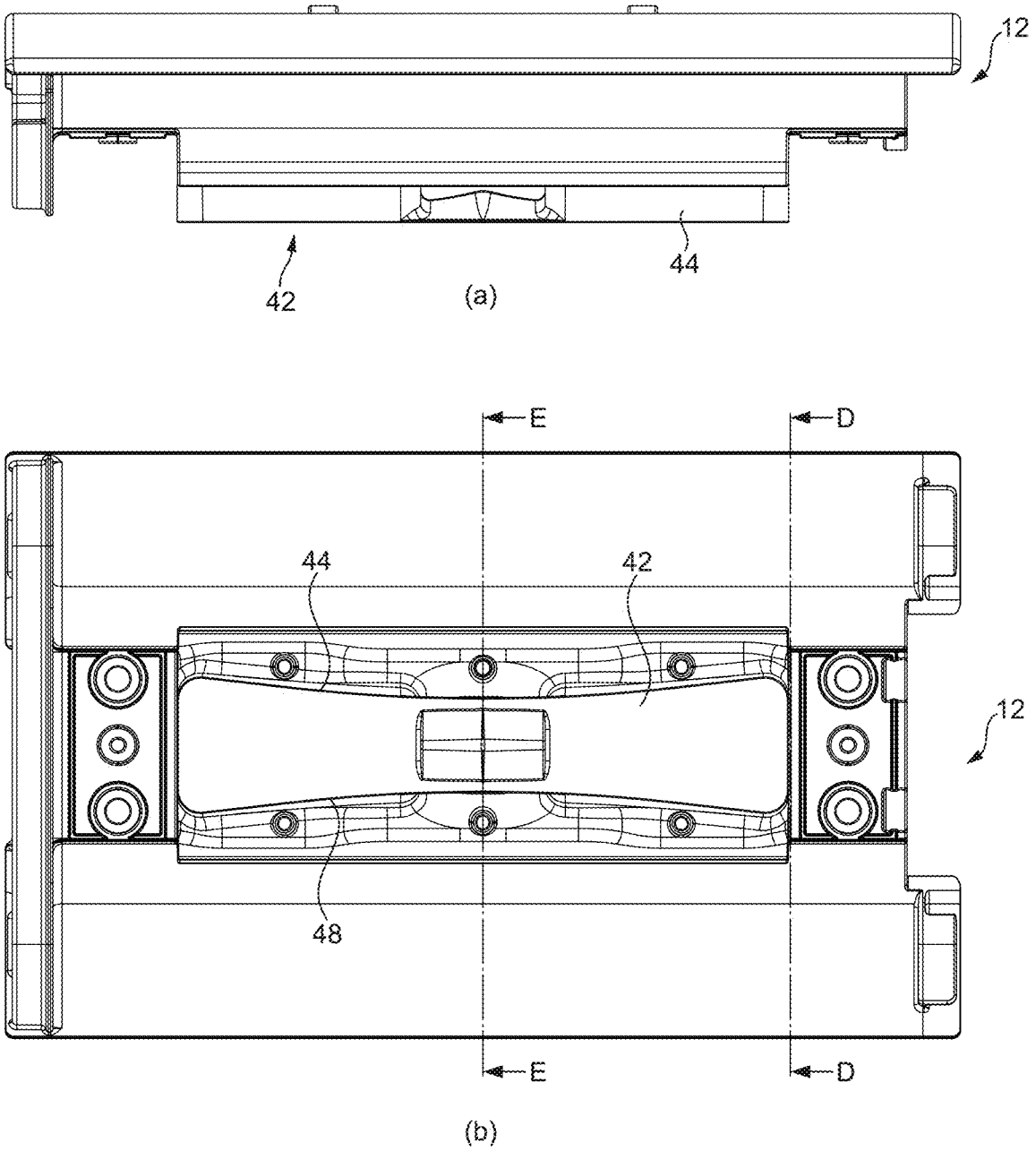
FIG. 10(*a*) is a front view of the housing of the cleaner head, and FIG. 10(*b*) is a bottom view of the housing.
Figure 11:
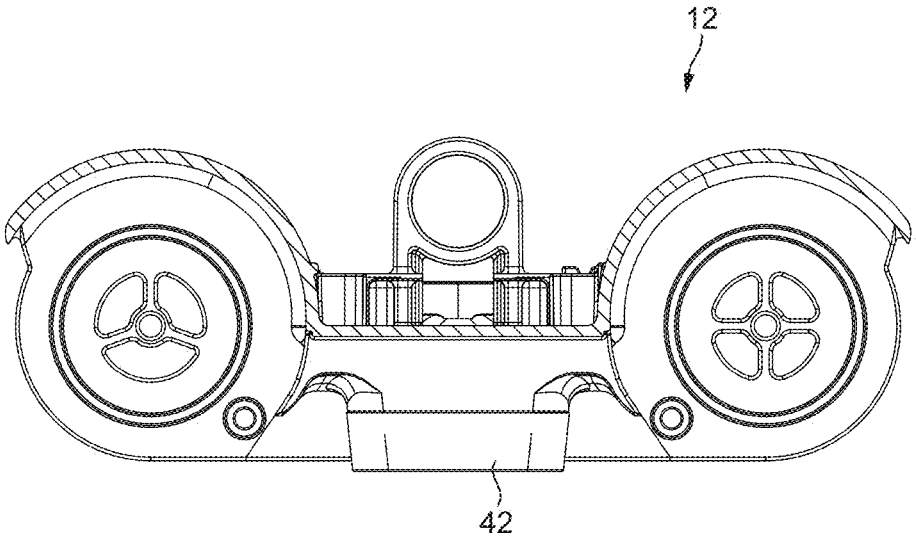
FIG. 11(*a*) is a sectional view of the housing, taken along line D-D in FIG. 10(*b*), and FIG. 11(*b*) is a sectional view of the housing, taken along line E-E in FIG. 10(*b*), FIG. 12(*a*) is a top view of a baffle plate of the housing, FIG. 12(*b*) is a side view of the baffle plate, and FIG. 12(*c*) is a bottom view of the baffle plate.
Figure 11:
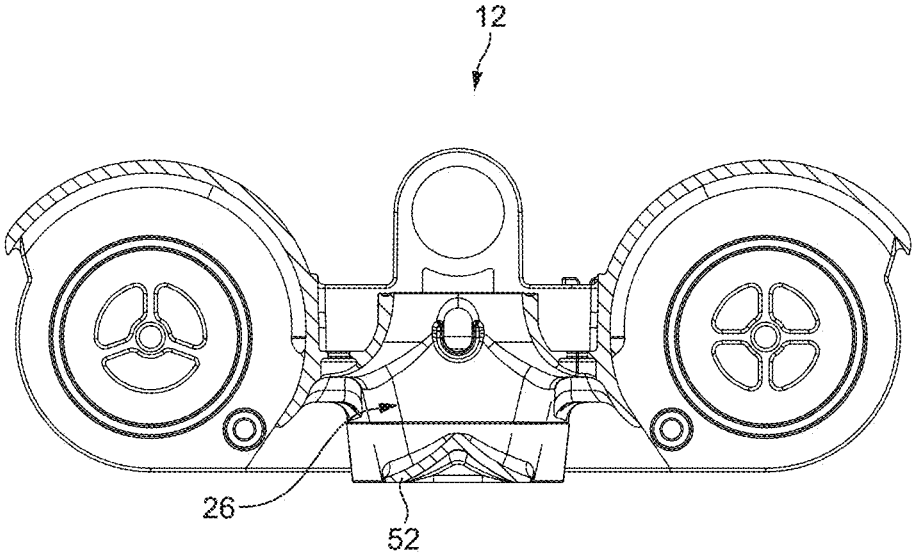
Figure 12:
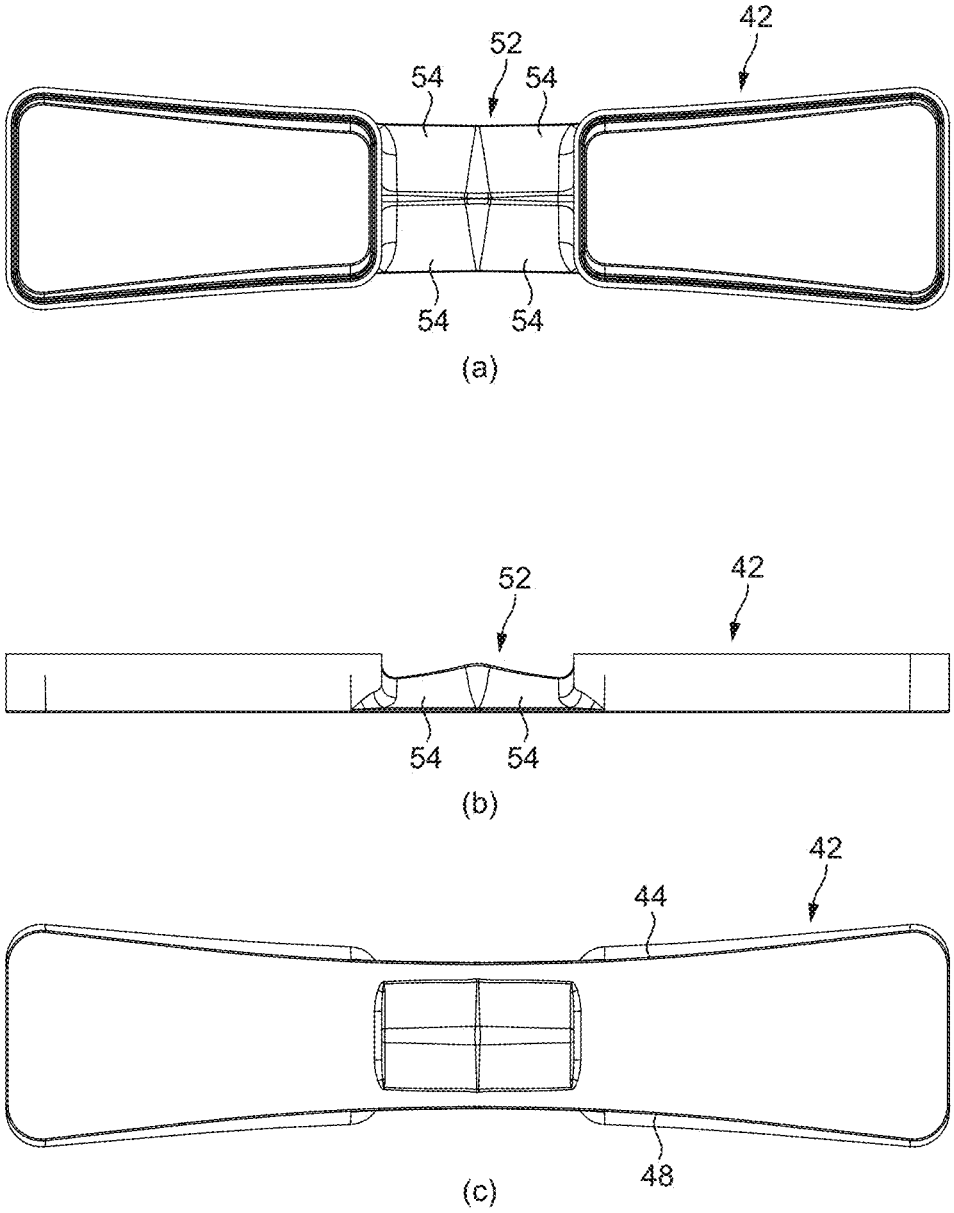

Whilst the supports 60, 62 may be mounted directly to the housing 12, in this embodiment, the cleaner head 10 comprises a pair of cartridges 66, 68 which are connected to the housing 12 by means of bolts 70, and which each comprises a respective one of the front wheels 56 and a respective one of the rear wheels 58. Each of the supports 60, 62 for those wheels 56, 58 is mounted on the cartridge 66, 68 for rotation relative thereto. With reference also to FIG. 6, as described in more detail below each cartridge 66, 68 comprises opposing end walls 72, which each comprise a respective aperture 74, 76. The supports 60, 62 are mounted on the cartridges 66, 68 so that each of the front supports 60 is positioned adjacent a respective front aperture 74, and so that each of the rear supports 62 is positioned adjacent a respective rear aperture 76.

In use, air from the external environment is drawn towards the suction chamber 26 under the action of a suction generator located within the vacuum cleaning appliance. When the cleaner head 10 is positioned on a floor surface, relatively large debris, such as rice or Cheerios®, is unable to pass beneath the rotating agitators due to their engagement with the floor surface. Instead, this relatively large debris enters the suction chamber 26 through becoming entrained within the airflows (hereafter referred to as "side airflows") which pass from the ends of the agitators 14, 16 inwardly towards the suction port 40.

When the cleaner head 10 is moved forwards towards a pile of relatively large debris located on the floor surface, generally that debris becomes entrained within side airflows which enter the suction chamber 26 though the front suction inlet 46. A first side airflow passes from a first end of the front agitator 14, through the front aperture 74 of the cartridge 66 and into the suction chamber 26 via the front suction inlet 46. A second side airflow passes from a first end of the front agitator 14, through the front aperture 74 of the cartridge 68 and into the suction chamber 26 via the front suction inlet 46. Two side airflows also enter the suction chamber 26 from around the ends of the rear agitator 16, although, when the cleaner head is moving forwards, these additional side airflows tend not to bear as much relatively large debris.

Each of the supports 60, 62 provides a guide member for guiding towards the suction chamber 26 debris which is entrained within a respective debris-bearing side airflow. The external surfaces of the supports 60, 62 are each shaped to define a respective guide surface 78, 80. The guide surfaces 78, 80 are generally convex in shape, and shaped so that as debris impacts upon the guide surface 78, 80 it rebounds towards the suction chamber 26.

With reference first to FIG. 6, when the cleaner head 10 is moving in a forwards direction over a floor surface (in the direction of the arrow A1), the frictional forces generated between the floor surface and the wheels 56, 58 causes the wheels 56, 58, and thus their supports 60, 62, to rotate to the orientations illustrated in FIG. 6. The guide surfaces 78 of the front supports 60 become oriented such that they define with the front agitator 14 and the cartridges 66, 68 relatively narrow channels 82 which extend from the front apertures 74 to the suction chamber 26. As debris-bearing side airflows enter the channels 82, the guide surfaces 78 of the front supports 60 guide the debris towards the front suction inlet 46. The width of the channels 82 tends to cause the airflow to accelerate as it moves along the channel 82, which also serves to promote the passage of debris into the suction chamber 26.

When the direction of the movement of the cleaner head is reversed so that it is moving in a backwards direction towards the remaining debris (in the direction of the arrow A2 shown in FIG. 15), the two side airflows entering the suction chamber 26 from around the ends of the rear agitator 16 become more heavily debris-bearing. The frictional forces generated between the floor surface and the wheels 56, 58 causes the wheels 56, 58, and thus their supports 60, 62, to rotate through 180° to the orientations illustrated in FIG. 15. The guide surfaces 80 of the rear supports 62 become oriented such that they define with the rear agitator 16 and the cartridges 66, 68 relatively narrow channels 84 which extend from the rear apertures 76 to the suction chamber 26. As debris-bearing side airflows enters the channels 84, the guide surfaces 80 of the rear supports 62 guide the debris towards the rear suction inlet 50.

Within the suction chamber 26, the front edge 44 of the baffle plate 42 guides towards the suction port 40 debris which is entrained within the two side airflows which have entered the suction chamber 26 via the channels 82, whilst the rear edge 48 of the baffle plate 42 guides towards the suction port 40 debris which is entrained within the two side airflows which have entered the suction chamber 26 via the channels 84. Towards the centre of the suction chamber 26, the four side airflows are each guided upwardly towards the suction port 40 by a respective face 54 of the baffle 52, carrying the entrained debris towards the conduit 36 of the neck 18. The side airflows coalesce downstream of the baffle 52, and pass through the conduit 36 and into the vacuum cleaning appliance, which separates the debris from the air.

The invention claimed is:

1. A cleaner head for a vacuum cleaning appliance, the cleaner head comprising:

a housing;

a front agitator supported for rotation relative to the housing in a first rotational direction;

a rear agitator supported for rotation relative to the housing in a second rotational direction opposite to the first rotational direction;

a suction chamber located between the front agitator and the rear agitator; and a baffle disposed on a baffle plate and being located within the suction chamber, wherein the suction chamber comprises a suction port located above the baffle, the baffle being operative to guide air towards the suction port during use of the cleaner head, wherein a width of the baffle plate adjacent to the suction port as measured perpendicular to a length of the baffle plate is less than the width at ends of the baffle plate, wherein: the front agitator is supported for rotation about a first axis relative to the housing in the first rotational direction; and the rear agitator is supported for rotation about a second axis relative to the housing in the second rotational direction, wherein the first and second axes are parallel, wherein: the width of the baffle plate extends in a direction perpendicular to the first and second axes; and the length of the baffle plate extends in a direction parallel with the first and second axes.

2. The cleaner head according to claim 1, wherein the baffle is located directly beneath the suction port.

3. The cleaner head according to claim 1, wherein the baffle extends towards the suction port.

4. The cleaner head according to claim 1, wherein the baffle is generally pyramidal in shape.

5. The cleaner head according to claim 1, wherein the baffle plate extends across the suction chamber.

6. The cleaner head according to claim 5, wherein the baffle plate is detachably connected with the housing.

7. The cleaner head according to claim 5, wherein the baffle plate is located at a bottom of the suction chamber.

8. The cleaner head according to claim 5, wherein the baffle plate at least partially defines a front suction inlet located between the baffle plate and the front agitator, and a rear suction inlet located between the baffle plate and the rear agitator.

9. The cleaner head according to claim 8, wherein the front suction inlet and the rear suction inlet have substantially the same size and same shape.

10. The cleaner head according to claim 5, wherein the baffle plate comprises a front edge adjacent the front agitator, and a rear edge adjacent the rear agitator, and wherein both the front edge and the rear edge taper inwardly towards the suction port in a direction of the width of the baffle plate for directing debris towards the suction port for both forward and backwards use of the cleaner head.

11. The cleaner head according to claim 1, comprising front guide members attached to the housing for, during use, guiding the debris from the ends of the front agitator towards the suction chamber, and rear guide members attached to the housing for, during use, guiding debris from the ends of the rear agitator towards the suction chamber.

12. The cleaner head according to claim 11, wherein each of the front guide members is located adjacent a respective end of the first agitator, and each of the rear guide members is located adjacent a respective end of the second agitator.

13. The cleaner head according to claim 11, wherein each of the front guide members and the rear guide members is rotatable relative to the housing.

14. The cleaner head according to claim 13, wherein each of the front guide members and the rear guide members is rotatable relative to the housing about an axis which is perpendicular to the rotational axes of the agitators.

15. The cleaner head according to claim 13, further comprising a plurality of cartridges connected to the housing, each cartridge comprising one of the front guide members and one of the rear guide members mounted for rotation relative to the cartridge.

16. The cleaner head according to claim 15, wherein each cartridge engages a respective side surface of the baffle.

17. The cleaner head according to claim 11, wherein each of the front guide members defines with the front agitator a respective first channel along which entrained debris is guided towards the front suction inlet, and each of the rear guide members defines with the rear agitator a respective second channel along which entrained debris is guided towards the rear suction inlet.

18. The cleaner head according to claim 17, wherein each of the front guide members and the rear guide members comprises a convex guide surface for defining a respective one of the first or second channels.

* * * * *